United States Patent [19]

Swanson

[11] Patent Number: 4,674,485

[45] Date of Patent: Jun. 23, 1987

[54] PATIENT CONTROLLABLE TRACTION DEVICE

[76] Inventor: Robert E. Swanson, 1140 Wall St., La Jolla, Calif. 92037

[21] Appl. No.: 740,751

[22] Filed: Dec. 12, 1985

[51] Int. Cl.[4] ..... A61H 1/02

[52] U.S. Cl. ..... 128/75

[58] Field of Search ..... 128/71, 75; 272/118, 272/120

[56] References Cited

U.S. PATENT DOCUMENTS

| | | | |
|---|---|---|---|
| 1,556,496 | 10/1925 | Davis | 272/120 |
| 2,665,685 | 1/1954 | Kaufman | 128/75 |
| 2,674,996 | 4/1954 | Stowell et al. | 128/75 |
| 2,830,581 | 4/1958 | Sanders | 128/75 |
| 3,105,489 | 10/1963 | Zivi | 128/75 |
| 3,114,366 | 12/1963 | Maychark | 128/75 |
| 4,431,184 | 2/1984 | Lew et al. | 272/118 X |

FOREIGN PATENT DOCUMENTS

| | | | |
|---|---|---|---|
| 2355848 | 5/1974 | Fed. Rep. of Germany | 128/71 |
| 3039441 | 5/1982 | Fed. Rep. of Germany | 128/75 |
| 1239682 | 7/1971 | United Kingdom | 128/75 |

*Primary Examiner*—Richard T. Stouffer

*Attorney, Agent, or Firm*—Brumbaugh, Graves, Donohue & Raymond

[57] ABSTRACT

A patient controlled traction device in which a mechanical advantage pulley system is used to multiply the traction applied by a weight and in which a mechanical advantage pulley system is used to enable the patient to relieve the force of the traction by the application of a relatively small force, substantially less than the weight utilized.

2 Claims, 3 Drawing Figures

PATIENT CONTROLLABLE TRACTION DEVICE

This invention relates to a novel patient controlled traction device and, more particularly, to a traction device in which the patient can relieve the traction.

The present invention relates to a traction device of a relatively simple construction which the patient can readily assemble in any convenient location, for example, at home adjacent to a bed or sofa, apply the prescribed traction and relieve the traction at his convenience without the assistance of a nurse or attendant.

The patient controlled traction device of the present invention includes a system which multiplies the force applied to a traction applying means while providing means to permit the patient to relieve the traction and restore the prescribed traction at his convenience. The patient controlled traction device permits the patient to relieve and restore a relatively large traction force by the application of a smaller force.

For a more complete understanding of the present invention, reference can be made to the description which follows and to the accompanying drawings in which.

Figure 1:
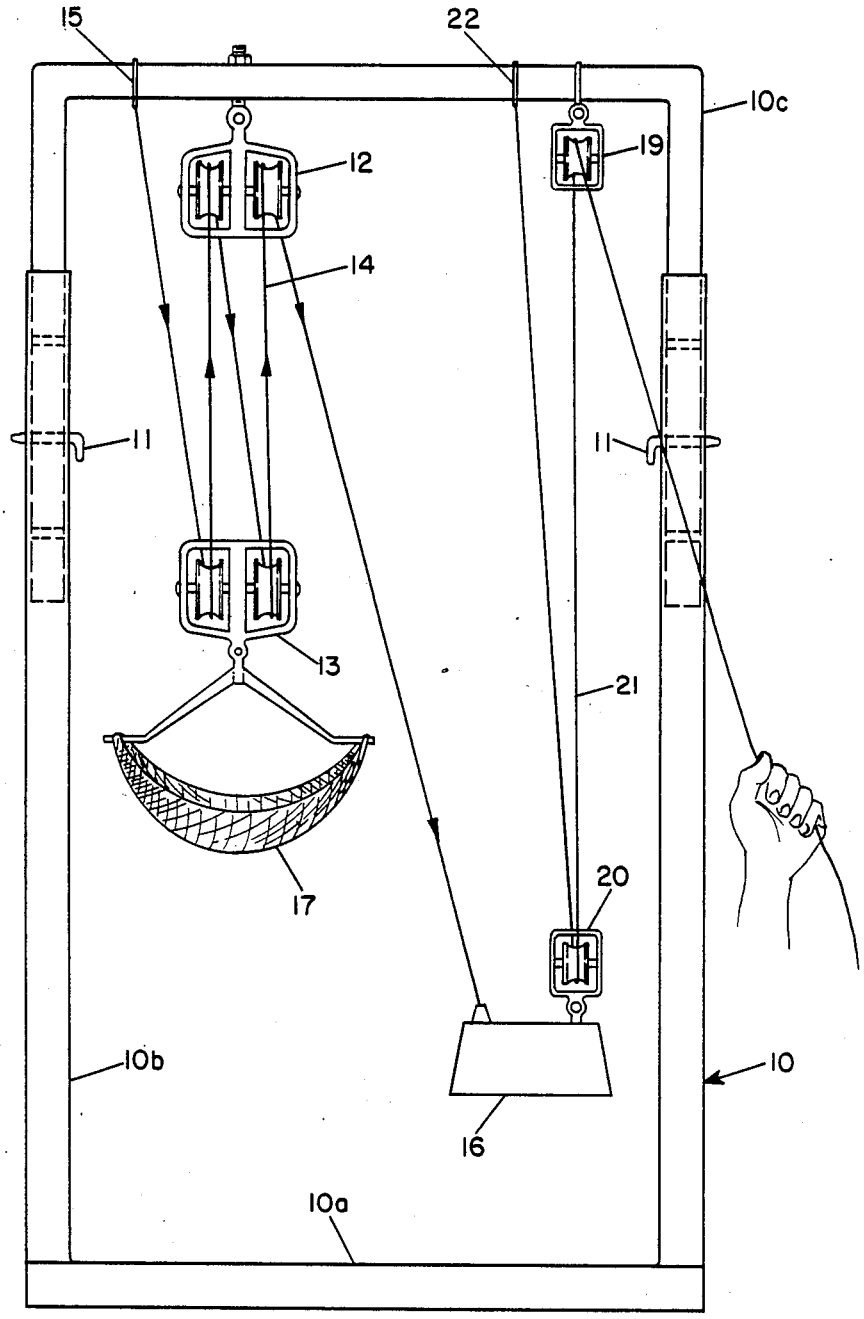
FIG. 1 is a front elevational view of the traction device of the present invention.
Figure 2:
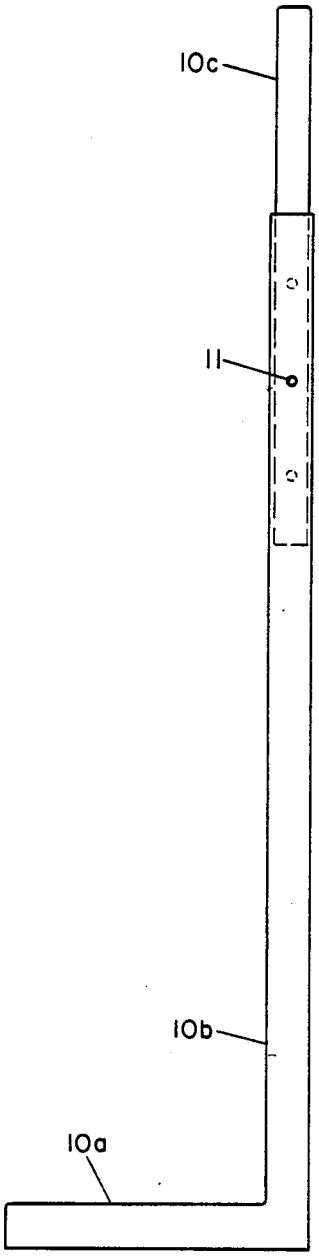
FIG. 2 is a side elevational view.

Referring to FIGS. 1 and 2 of the drawings, the traction device of the present invention includes an L-shaped frame 10 having a base 10*a*, a pair of uprights 10*b* and an upper vertically adjustable support 10*c* having depending legs locked by pins 11 in telescoping relation with the uprights 10*b*.

A mechanical advantage pulley system is mounted to the support 10*c*. The pulley system includes an upper block 12 mounted from the adjustable support 10*c* and a lower block 13 supported from the upper block by a flexible connection 14. The flexible connection 14 is connected at one end 15 to the adjustable support 10*c* and at the other end to a weight 16. A traction applying means 17 is connected to the lower block. In the embodiment shown in the drawings, the pulley system provides a 4:1 mechanical advantage so that the weight applies a 4:1 upward force on the traction applying means 17.

The traction relieving means includes a mechanical advantage pulley system mounted from the vertically adjustable support 10*c*. This pulley system includes a pulley block 19 mounted from the support 10*c* and a pulley block 20 connected to the weight 16 and supported from the upper pulley block 19 by a flexible connection 21. The flexible connection 21 is anchored at one end 22 to the support 10*c*, and the opposite end 23 is accessible to the patient to pull for relieving some or all of the traction force exerted by the weight 16 or to release for restoring some or all of the traction force when the patient is prepared to endure the prescribed traction.

The weights used can vary, for example, in the range of from 2 to 15 pounds, depending on how much traction is desired. Since the mechanical advantage of the pulley system applying the traction is 4:1, 5 pounds of weight will produce a traction force of 20 pounds. The ratio of the traction relieving pulley system is 2:1, so that to relieve 20 pounds of traction, the patient need only pull with a force of 2.5 pounds. The traction force can be gradually relieved and gradually restored to the prescribed level. Due to friction in the pulley system, full traction is not achieved until the patient raises his head slightly and then releases it, causing the weight to descend against the resistance of the patient's head and body.

Figure 3:
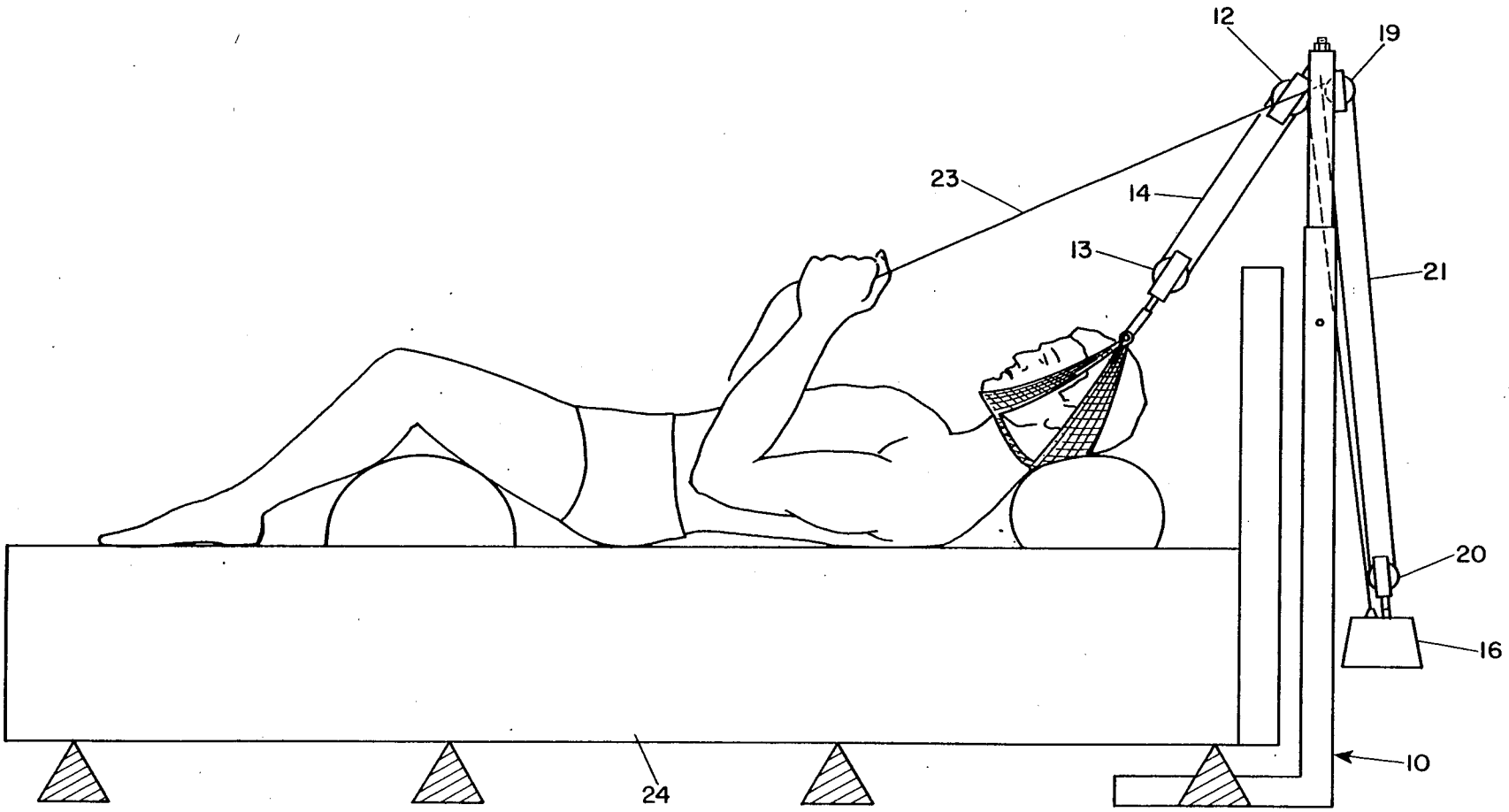
FIG. 3 is a side elevational view of the traction device set up adjacent a bed or sofa and showing traction applied to the neck of a patient.

The ideal way for the device to be used is for the patient to lie in bed or on a sofa 24, as shown in FIG. 3, on his back with the device at the headboard end. The patient may read, watch television or just relax while neck tension is relieved. When the traction device is used in the manner shown and described in connection with FIG. 3, the adjustment of the vertical height of the support 10*c* permits variation of the angle of traction in accordance with the needs of different patients.

The invention has been shown and described in preferred form and by way of example, and many variations and modifications may be made within the spirit of the invention. The invention, therefore, is not intended to be limited to any specified form or embodiment, except insofar as such limitations are expressly set forth in the claims.

I claim:

1. A patient controllable traction device, comprising traction applying means, a support, a first mechanical advantage pulley system supported by said support, said pulley system supporting the traction applying means from said support, said first pulley system having a first flexible connection with a weight supporting end, a weight supported from said weight supporting end, said first pulley system including means to multiply the force applied to the traction applying means by the weight through the first pulley system, and a second mechanical advantage pulley system including means for partially supporting the weight from said support, said second pulley system having a second flexible connection with a patient controllable end and an end fixed to said support, said second pulley system including means to multiply the force exerted by the patient, so that when a relatively small force is exerted by the patient, the weight will be partially supported by the patient exerted force and will relieve a greater traction force.

2. A patient controllable traction device comprising traction applying means, a support, a weight, a first mechanical advantage pulley system having a first flexible connection fixed at one end to the support and connected to the weight at the other end, said first mechanical advantage pulley system being supported by the support, said first pulley system supporting the traction applying means, the mechanical advantage of said first mechanical advantage pulley system including means to multiply the force applied to the traction applying means by the weight through the pulley system, and a second mechanical advantage pulley system having a second flexible connection fixed at one end to the support and controllable by the patient at the other end, said second mechanical advantage pulley system being supported by the support, said second pulley system supporting the weight, the mechanical advantage of said second mechanical pulley system including means to multiply the force applied by the patient so that when a relatively small force is exerted by the patient the weight will be partially supported by the patient exerted force and will relieve a greater traction force.

* * * * *